US005708446A

United States Patent [19]

Laramie

[11] Patent Number: 5,708,446

[45] Date of Patent: Jan. 13, 1998

[54] PRINTED CIRCUIT ANTENNA ARRAY USING CORNER REFLECTOR

[75] Inventor: Daniel George Laramie, San Diego, Calif.

[73] Assignee: Qualcomm Incorporated, San Diego, Calif.

[21] Appl. No.: 698,835

[22] Filed: Aug. 16, 1996

Related U.S. Application Data

[63] Continuation of Ser. No. 427,776, Apr. 29, 1995, abandoned.

[51] Int. Cl.[6] ..... H01Q 9/28; H01Q 21/12

[52] U.S. Cl. ..... 343/815; 343/795; 343/818; 343/821

[58] Field of Search ..... 343/795, 815, 343/817, 818, 819, 700 MS, 810, 813, 820, 821; H01Q 9/28, 21/12

[56] References Cited

U.S. PATENT DOCUMENTS

| | | | |
|---|---|---|---|
| 2,656,463 | 10/1953 | Woodward, Jr. | 250/33.53 |
| 3,887,925 | 6/1975 | Rangbelli et al. | 343/795 |
| 4,001,837 | 1/1977 | Regenos et al. | 343/815 |
| 4,103,303 | 7/1978 | Regenos et al. | 343/100 |
| 4,114,163 | 9/1978 | Borowick | 343/795 |
| 4,121,215 | 10/1978 | Barbano | 343/18 C |
| 4,654,622 | 3/1987 | Foss et al. | 338/14 |
| 5,021,799 | 6/1991 | Kobus et al. | 343/795 |
| 5,087,922 | 2/1992 | Tang et al. | 343/814 |
| 5,270,671 | 12/1993 | Waterman | 343/700 MS |

FOREIGN PATENT DOCUMENTS

| | | | |
|---|---|---|---|
| 57-38004 | 3/1982 | Japan | 343/700 MS |

OTHER PUBLICATIONS

E. Levine, P. Perlmutter and D. Treves, "Double-Sided Printed Dipole Arrays" Department of Electronics, The Weizmann Institute of Science, Rehovot 76100 Israel, pp. 2.3.10.

A. C. Wilson and H. V. Cottony, "IRE Transactions on Antennas and Propagation", Radiation Patterns of Finite-Size Corner-Reflector Antennas, Mar. 1960.

E. Levine, J. Ashkenazy and D. Treves, "Printed Dipole Arrays on a Cylinder", Technical Feature, Microwave Journal, Mar. 1987.

*Primary Examiner*—Hoanganh T. Le

*Attorney, Agent, or Firm*—Russell B. Miller; Sean English

[57] ABSTRACT

A corner reflector antenna array capable of being driven by a coaxial feed line is disclosed herein. The antenna array comprises a substantially right-angle corner reflector having first and second reflecting surfaces. A dielectric substrate is positioned adjacent the first reflective surface, and defines first and second opposing substrate surfaces. In the preferred implementation the dielectric substrate is oriented substantially parallel to, but spaced from, the second reflective surface. The antenna array further includes a plurality of dipole elements, each of the dipole elements including a first half dipole disposed on the first substrate surface and a second half dipole disposed on the second substrate surface. A twin line interconnection network, disposed on both the first and second substrate surfaces, carries signal energy to and from the plurality of dipole elements. The segments of the interconnection network immediately proximate the dipole elements are preferably oriented normal to the radiation emitted thereby, and are thereby prevented from interfering with the antenna radiation pattern. A printed circuit balun is used to connect the center and outer conductors of a coaxial feed line to the segments of the interconnection network disposed on the first and second substrate surfaces, respectively.

23 Claims, 6 Drawing Sheets

PRINTED CIRCUIT ANTENNA ARRAY USING CORNER REFLECTOR

This is a continuation of application Ser. No. 08/427,776, filed Apr. 25, 1995, now abandoned.

BACKGROUND OF THE INVENTION

I. Field of the Invention

The present invention relates generally to antennas, and more particularly to a printed circuit antenna array using a corner reflector.

II. Description of the Related Art

Satellite communication systems have been developed in an effort to enable continuous delivery of messages and related control information to a large number of vehicles over a wide geographic area. Such a satellite-based message communication system is described in, for example, U.S. Pat. No. 4,979,170, entitled ALTERNATING SEQUENTIAL HALF DUPLEX COMMUNICATION SYSTEM, issued Dec. 18, 1990, which is assigned to the assignee of the present invention and which is herein incorporated by reference. In U.S. Pat. No. 5,017,926 (the '926 patent), entitled DUAL SATELLITE NAVIGATION SYSTEM, issued May 21, 1991, which is also assigned to the assignee of the present invention, there is disclosed a system in which a communication terminal associated with each vehicle is capable of determining position in addition to providing messaging capability.

Each such communication terminal is typically configured with a directive antenna disposed to track a given satellite during vehicle motion. When the vehicle changes direction, the azimuth angle from the vehicle relative to the satellite also changes. In order to ensure that the antenna provides adequate gain in the direction of the satellite, it is desirable that the antenna beamwidth in the azimuth dimension be relatively narrow (e.g., 4 degrees). It is further desirable that the antenna beamwidth in the elevational dimension permit communication with satellites when the vehicle is located within a given range of latitudes on the surface of the earth. Moreover, by introducing horizontal and/or vertical polarization into the electric field of the antenna, the communication terminal's channel capacity may be increased. While a number of different types of antennas could be used to meet these specifications, many common antenna designs are too bulky or complex to be easily incorporated within a vehicle communications terminal.

Referring to FIG. 1, an illustration is provided of a directive antenna 10 known as a corner reflector. The corner reflector antenna 10 includes a pair of conductive planes 12 and 14 which intersect at a vertex 18. A dipole radiator 20, having left and right dipole elements 22 and 24, is positioned near the vertex 18 so as to enable projection of a horizontally-polarized beam. If the beam projected by the directive antenna 10 is also to be symmetric, the left and right dipole halves 22 and 24 must be fed with currents of identical magnitude and opposite phase. This requirement prevents a coaxial line 28 (which passes through aperture 29) from being directly used to feed the dipole radiator 20, since doing so results in an unequal distribution of current between the left and right dipole halves 22 and 24. Rather, a balun (not shown) must be used in conjunction with coaxial line 28.

The use of a balun provides one mechanism for preventing the development of current imbalance within a dipole fed by a coaxial line. Such a coaxial balun can be fabricated by enclosing the outer coaxial conductor with a conductive sleeve. However, coaxial balun structures are not easily integrated within many types of antenna systems, such as corner reflector antennas. Moreover, a separate step is generally required to realize the balun during manufacture of the antenna system in which it is incorporated.

A further difficulty encountered during manufacture of corner reflector antennas involves coupling of the dipole or other radiative element to a feed network. Typically, this coupling is achieved through a feed cable or the like extending through an aperture defined near the vertex of the corner reflector. This tends to complicate manufacture of the antenna by requiring creation of such an aperture, and may also interfere with the provision of dielectric material or the like between the conductive planes 12 and 14.

Turning again to FIG. 1, the radiation pattern produced by the antenna 10 can be modified somewhat in the elevational dimension by adjustment of the angle of intersection between the conductive planes 12 and 14 of the corner reflector. However, this angular adjustment has insignificant effect upon the beamwidth of the radiation pattern in the azimuth dimension.

Accordingly, it is an object of the invention to provide a corner reflector antenna system capable of producing a radiation pattern of desired azimuth and elevational beamwidth. It is a further object of the invention that the corner reflector antenna system be disposed to be fed by a coaxial line without reliance upon a coaxial balun.

SUMMARY OF THE INVENTION

In summary, the present invention comprises a corner reflector antenna array capable of being driven by a coaxial feed line. The inventive antenna array is especially well-suited for implementation within devices required to produce fan-shaped radiation patterns, such as the mobile units used within satellite communication systems.

In a preferred embodiment, the antenna array comprises a substantially right-angle corner reflector having first and second reflecting surfaces. A dielectric substrate is positioned adjacent the first reflective surface, and defines first and second opposing substrate surfaces. In the preferred embodiment the dielectric substrate is oriented substantially parallel to, but spaced from, the second reflective surface.

The antenna array further includes a plurality of dipole elements, each of the dipole elements including a first half dipole disposed on the first substrate surface and a second half dipole disposed on the second substrate surface. A twin line interconnection network, disposed on both the first and second substrate surfaces, carries signal energy to and from the plurality of dipole elements. The segments of the interconnection network immediately proximate the dipole elements are oriented normal to the radiation emitted thereby, and are thereby prevented from interfering with the antenna radiation pattern. A printed circuit balun is used to connect the center and outer conductors of a coaxial feed line to the segments of the interconnection network disposed on the first and second substrate surfaces, respectively.

BRIEF DESCRIPTION OF THE DRAWINGS

Additional objects and features of the invention will be more readily apparent from the following detailed description and appended claims when taken in conjunction with the drawings, in which:

DESCRIPTION OF THE PREFERRED EMBODIMENT

Figure 1:
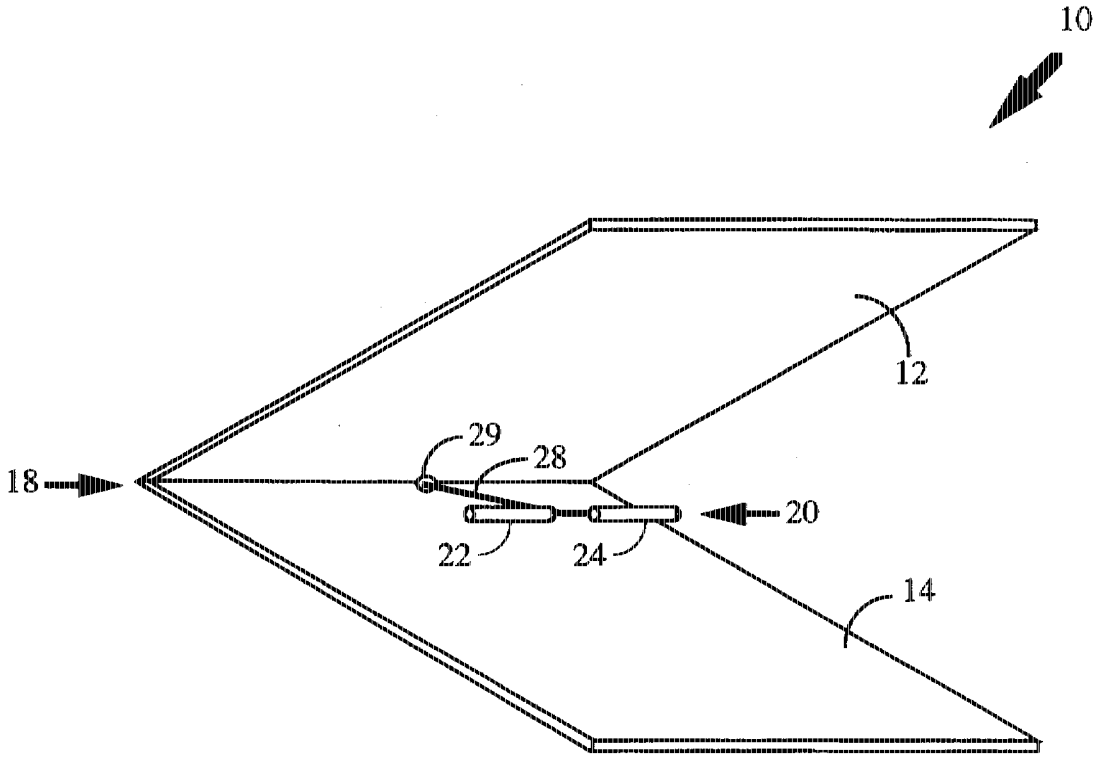
FIG. 1 PRIOR ART
FIG. 1. provides an illustration of a conventional corner reflector antenna.
Figure 2:
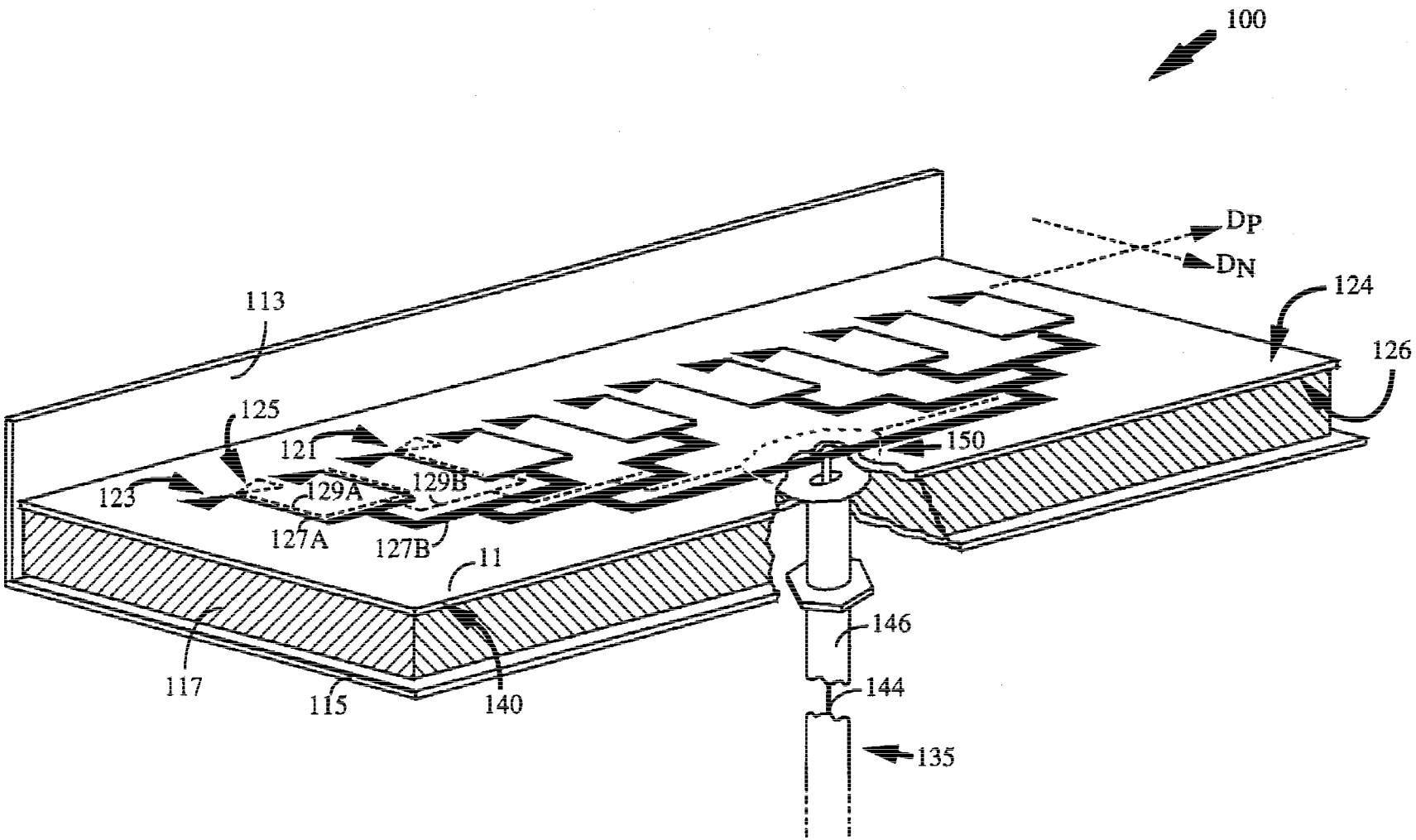
FIG. 2 is a perspective view of a corner reflector antenna array of the present invention.

FIG. 2 provides a perspective view of a preferred embodiment of a corner reflector antenna array 100 of the present invention. The antenna array 100 includes a substantially right-angle corner reflector defined by first and second reflectors 113 and 115. Although the first and second reflectors 113 and 115 are arranged orthogonally in FIG. 2, in alternate embodiments the angular relationship therebetween may be adjusted as necessary to modify the elevational beamwidth of the antenna array 100. Dielectric spacer 117 is mounted upon second reflector 115, and may be fabricated from material of a low dielectric constant (e.g., foam). In the presently preferred embodiment, the precise value of the dielectric constant of the dielectric spacer 117 is not critical, since the antenna array 100 is not operative to concentrate electric fields within the dielectric spacer 117 beneath dielectric substrate 119.

The dielectric substrate 119 is secured to spacer 117 and acts as a printed circuit board. (Although the circuits disposed on the dielectric substrate 119 are referred to herein as "printed circuits" such circuits could be created by any of a variety of methods well known in the art such as etching.) The dielectric substrate 119 will preferably be realized using a thin sheet of a dielectric material (e.g., Teflon) so as to not perturb the radiation focused by the first and second reflectors 113 and 115.

A plurality of dipole radiative elements, which in the preferred embodiment comprise an array of bow-tie dipoles 121, are disposed on opposing surfaces of dielectric substrate 119. A first half dipole 123 of each bow-tie dipole 121 is disposed upon an upper surface 124 of dielectric substrate 119, while a second half dipole 125 (shown in phantom) of each bow tie dipole 121 is disposed upon a lower surface 126 of dielectric substrate 119. Those skilled in the art will appreciate that the placement of the bow-tie dipoles 121 relative to the plane of the first reflector 113 influences the shape of the projected radiation pattern. An exemplary process for determining appropriate placement of radiative elements in a corner reflector antenna system is described in, for example, the article entitled "Radiation Patterns of Finite-Size Corner Reflector Antennas", by A. C. Wilson and H. B. Cottony, published in *I.R.E. Transactions on Antennas and Propagation* (March, 1960); the subject matter of which is incorporated herein by reference.

The array of bow-tie dipoles 121 are connected to a twin line interconnection network, which is used in coupling the array of bow-tie dipoles to a coaxial cable 135. The twin line interconnection network is comprised of a first transmission line distribution circuit 127 disposed upon the upper surface 124 of dielectric substrate 119, and a second transmission line distribution circuit 129 (shown in phantom) disposed upon the lower substrate surface 126. The first and second transmission line distribution circuits 127 and 129 comprise substantially identical circuit patterns, and directly oppose each other upon the upper and lower substrate surfaces 124 and 126. By locating the distribution circuits 127 and 129 on opposite sides of the dielectric substrate 119, signal power maybe provided to both the first and second half dipoles 123 and 125. If one attempted to locate the distribution circuits 127 and 129 on the same side of the dielectric substrate 119, the two circuit transmission lines would be required to cross at some point. By locating each distribution circuits 127 and 129 such an undesirable crossover can be avoided.

As is indicated by FIG. 2, the coaxial cable 135 is secured to the dielectric substrate 119 proximate an outer edge 140 thereof, and is seen to extend through second reflector 115 and dielectric spacer 117. A balun circuit 150 disposed on the upper and lower surfaces 124 and 126 serves to effectively transform the coaxial cable 135 into the twin line interconnection network comprised of the first and second distribution circuits 127 and 129. The center conductor 144 of coaxial cable 135 passes through the dielectric substrate 119 and contacts the trace of the balun circuit 150 disposed upon the upper substrate surface 124 (solid line), while the outer conductor 146 of coaxial cable 135 contacts the trace of balun circuit 150 disposed upon the lower substrate surface 126 (dashed line).

Figure 3A:
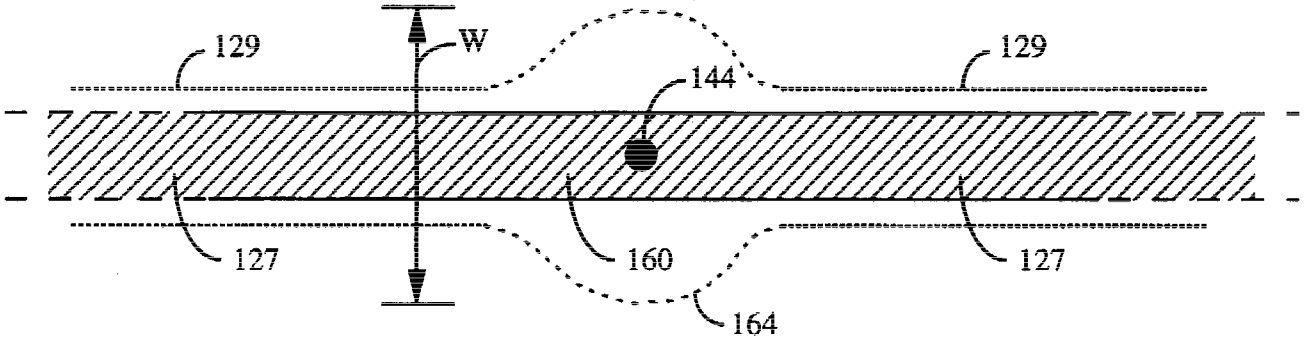
FIGS. 3A and 3B provide a magnified top view, and a cross-sectional side view, respectively, of a balun circuit.
Figure 3B:
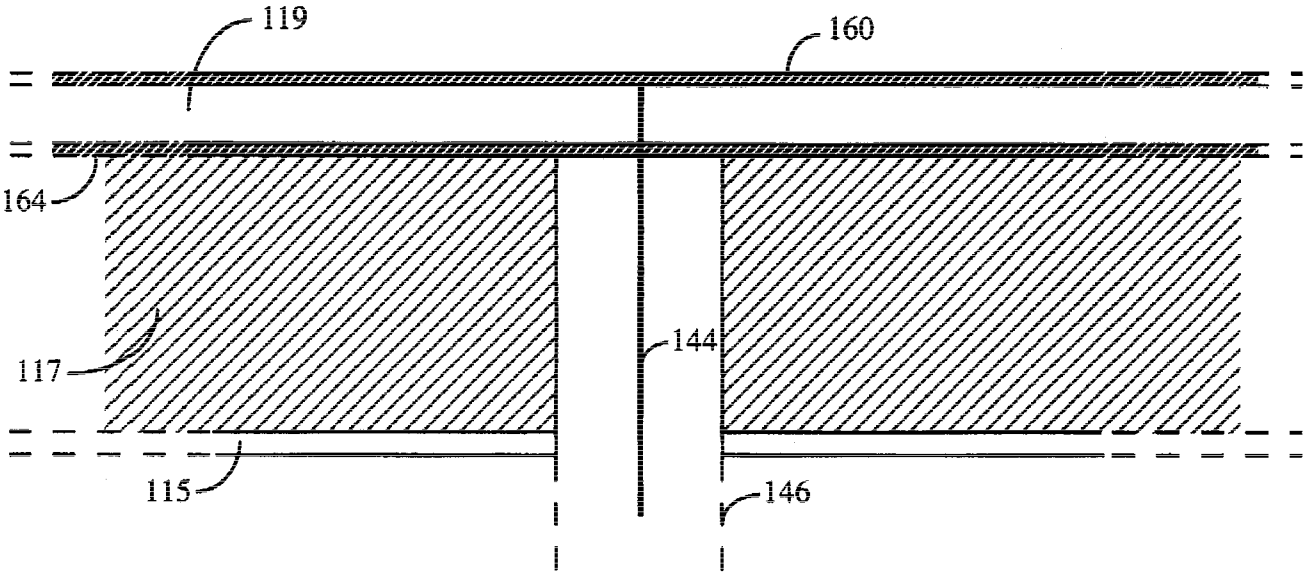

FIGS. 3A and 3B provide a magnified top view, and a cross-sectional side view, respectively, of the balun circuit 150. In FIG. 3A, the balun circuit trace disposed upon the upper substrate surface 124 is identified by reference numeral 160, while the balun circuit trace disposed upon the lower substrate surface 126 is identified by reference numeral 164. The balun circuit trace 160 transitions into the first distribution circuit 127 disposed upon the upper substrate surface 124, and the balun circuit trace 164 transitions into the second distribution circuit 129 disposed upon the lower substrate surface 126.

The balun circuit 150 is designed to facilitate transition of the coaxial cable 135 to the two twin line transmission lines comprised of distribution circuits 127 and 129. This entails matching the nominally 50 ohm impedance of the coaxial cable 135 to the parallel combination of the twin line transmission lines coupled to either side of the balun circuit 150. Accordingly, the upper surface balun circuit trace 160 will typically be dimensioned to provide an impedance of approximately 100 ohms near the perimeter of balun circuit 150.

As is indicated by FIG. 3A, the lower balun circuit trace 164 is of width "W" proximate the center conductor 144 of coaxial cable 135. In an exemplary embodiment the width W exceeds one-half wavelength of the signal energy coupled from the coaxial cable 135, thereby presenting a high impedance path relative to the preferred direction of current flow to and from the distribution circuits 127 and 129. FIG. 3B illustrates a side view of FIG. 3A. The center conductor 144 is shown passing through the second reflector 115, the dielectric spacer 117, the lower balun circuit trace 164 on the dielectric substrate 119, to connect to the upper surface balun circuit trace 160. The outer conductor 146 is shown passing through the second reflector 115 and the dielectric spacer 117 to connect to the lower balun circuit trace 164

Referring again to FIG. 2, the first and second reflectors 113 and 115 define an antenna radiation aperture proximate the bow-tie dipoles 121 in a plane transverse to the dielectric substrate 119. Within the radiation aperture, the electric field is concentrated and polarized in direction $D_p$. As shown in FIG. 2, the segments of the first and second distribution circuits 127 and 129 proximate the bow-tie dipoles 121 extend therefrom in a direction $D_n$ normal to the polarization direction $D_p$. In FIG. 2, the segments of the distribution circuits 127 and 129 extending in this normal direction $D_n$ are respectively identified by reference numerals 127*a* and 129*a*, and those segments parallel to the polarization direction $D_p$ are identified by the reference numerals 127*b* and 129*b*.

Although the distribution circuit segments 127*a* and 129*a* coupled to the bow-tie dipoles 121 run though the plane of the antenna radiation aperture, these segments extend normally to the polarization direction $D_p$. That is, the distribution circuits 127*a* and 129*a* are cross-polarized to the direction of the electric field $D_p$ within the radiation aperture, and hence do not perturb the antenna radiation pattern. The distribution circuit segments 127*b* and 129*b* are also arranged upon the dielectric substrate 119 so as not to interfere with the antenna radiation pattern. Namely, the distribution circuit segments 127*b* and 129*b* are located distal from the radiation aperture near the bow-ties 121, and are thus prevented from interacting with the concentrated electric field therein despite being oriented in the electric field polarization direction $D_p$. Since the balun circuit 150 is also located distal from the radiation aperture, it is also precluded from adversely affecting the antenna radiation pattern.

In the preferred embodiment, well-known corporate feed design principles are used to determine the line widths of the distribution circuits 127 and 129 necessary to establish a suitable impedance match with the bow-tie dipoles 121. Such corporate feed design techniques may also be employed to configure the distribution circuits 127 and 129 to effect an unequal distribution of power among the bow-tie dipoles 121. For example, antenna patterns with reduced sidelobe levels can be generated by delivering less power to the bow-tie dipoles 121 near the ends of the array than is delivered to the dipoles proximate the array center.

Figure 4:
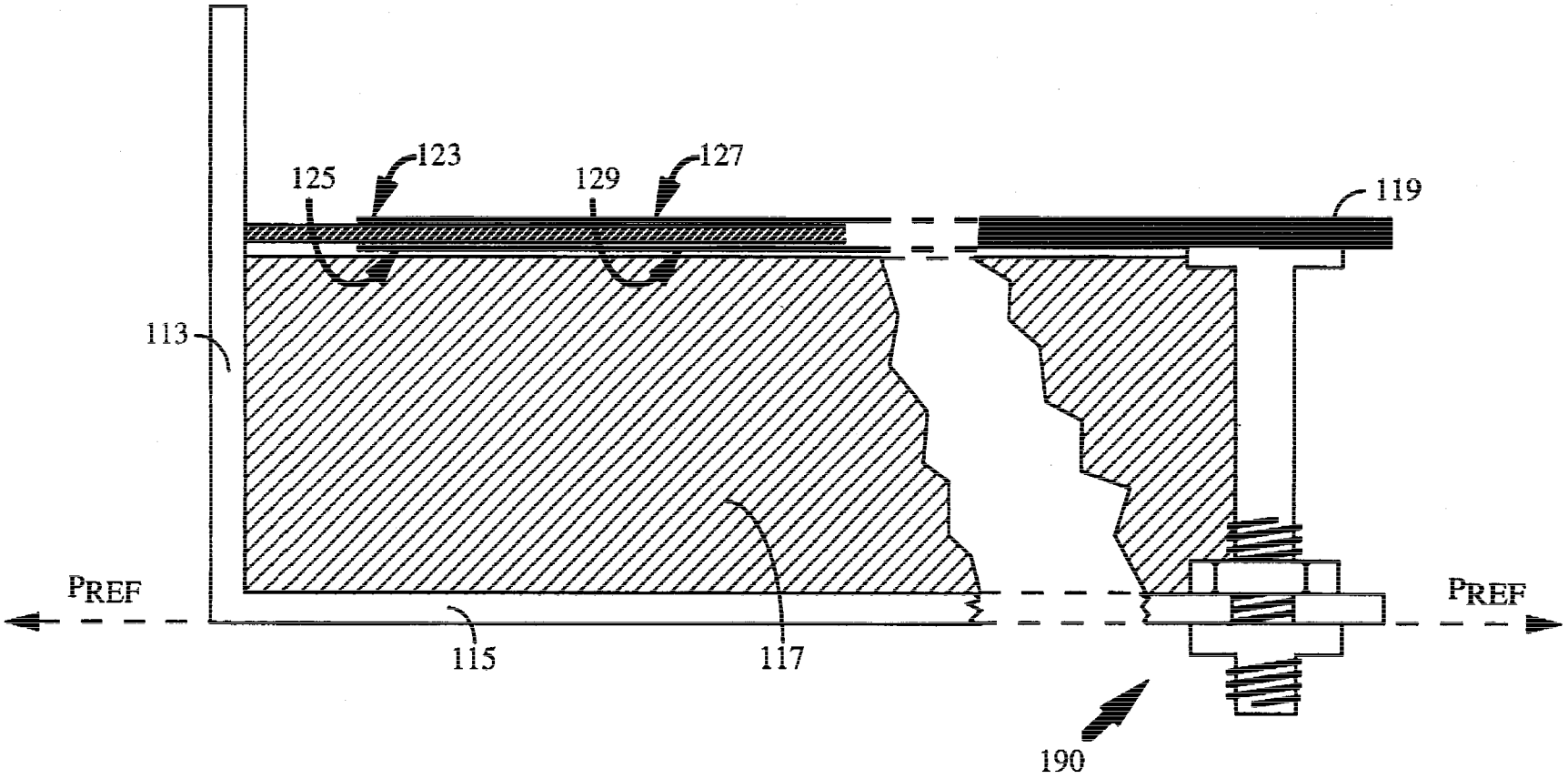
FIG. 4 provides a side view of a corner reflector array adapted to be rotated in the azimuth dimension.

FIG. 4 provides a side view of the corner reflector array 100 as adapted to be rotated within a reference plane ($P_{REF}$)defined by the second reflector 115. As shown in FIG. 4, coaxial cable connector 190 is secured at the outer edge of dielectric substrate 119. The coaxial cable 135 (not shown) is disposed within the coaxial cable connector 190, and electrically contacts the first and second distribution circuits 127 and 129 via the balun circuit 150 (FIGS. 3A and 3B). The entire corner reflector antenna array 100 is disposed to be rotated in the reference plane PREF about the coaxial cable connector 190 using, for example, a stepper motor (not shown). In a preferred embodiment tracking in the azimuth dimension is effected by rotation of the corner reflector array 100 in angular increments of 4 degrees.

Figure 5A:
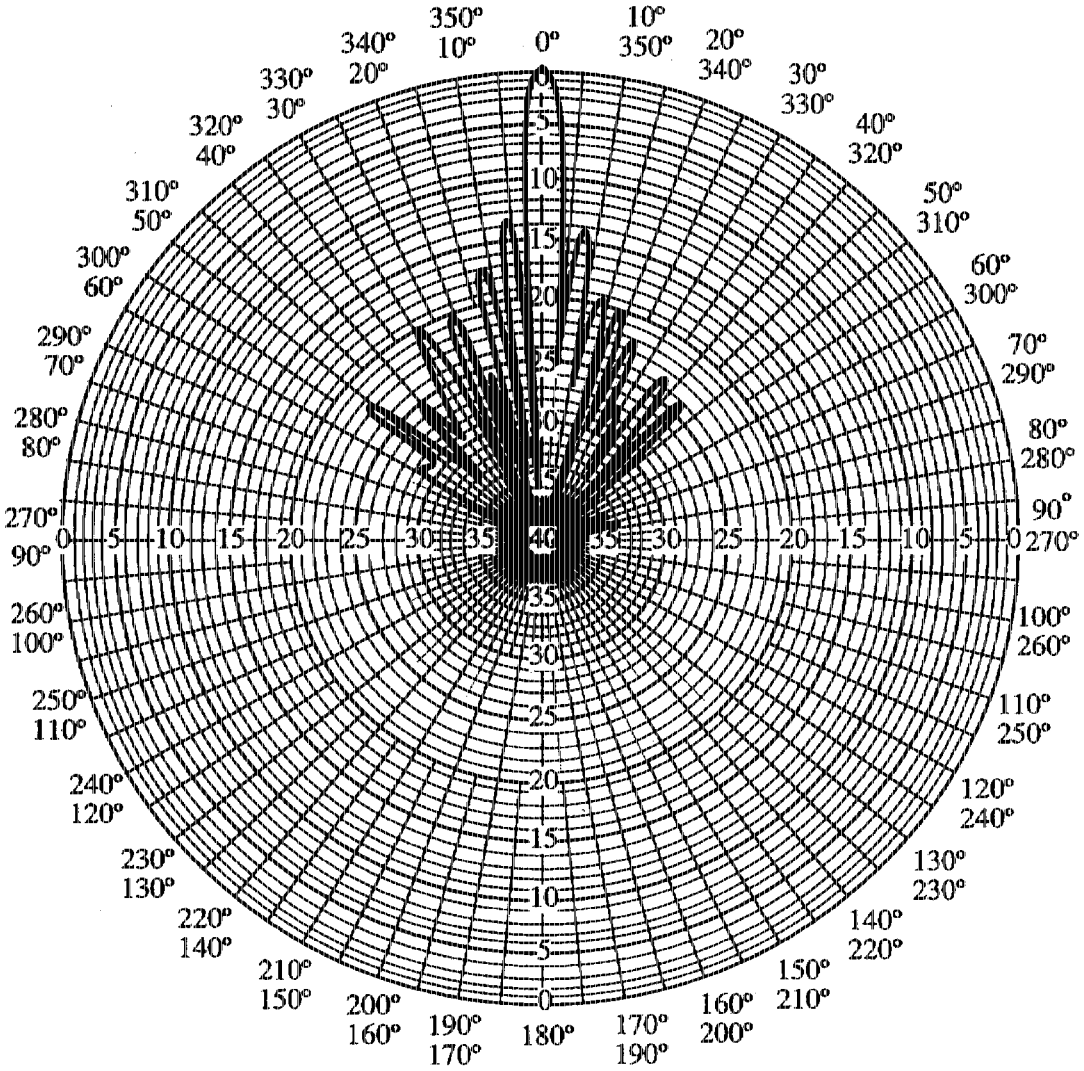
FIGS. 5A and 5B provide graphical representations in the azimuth and elevational dimensions, respectively, of an antenna beam produced by a corner reflector antenna array.
Figure 5B:
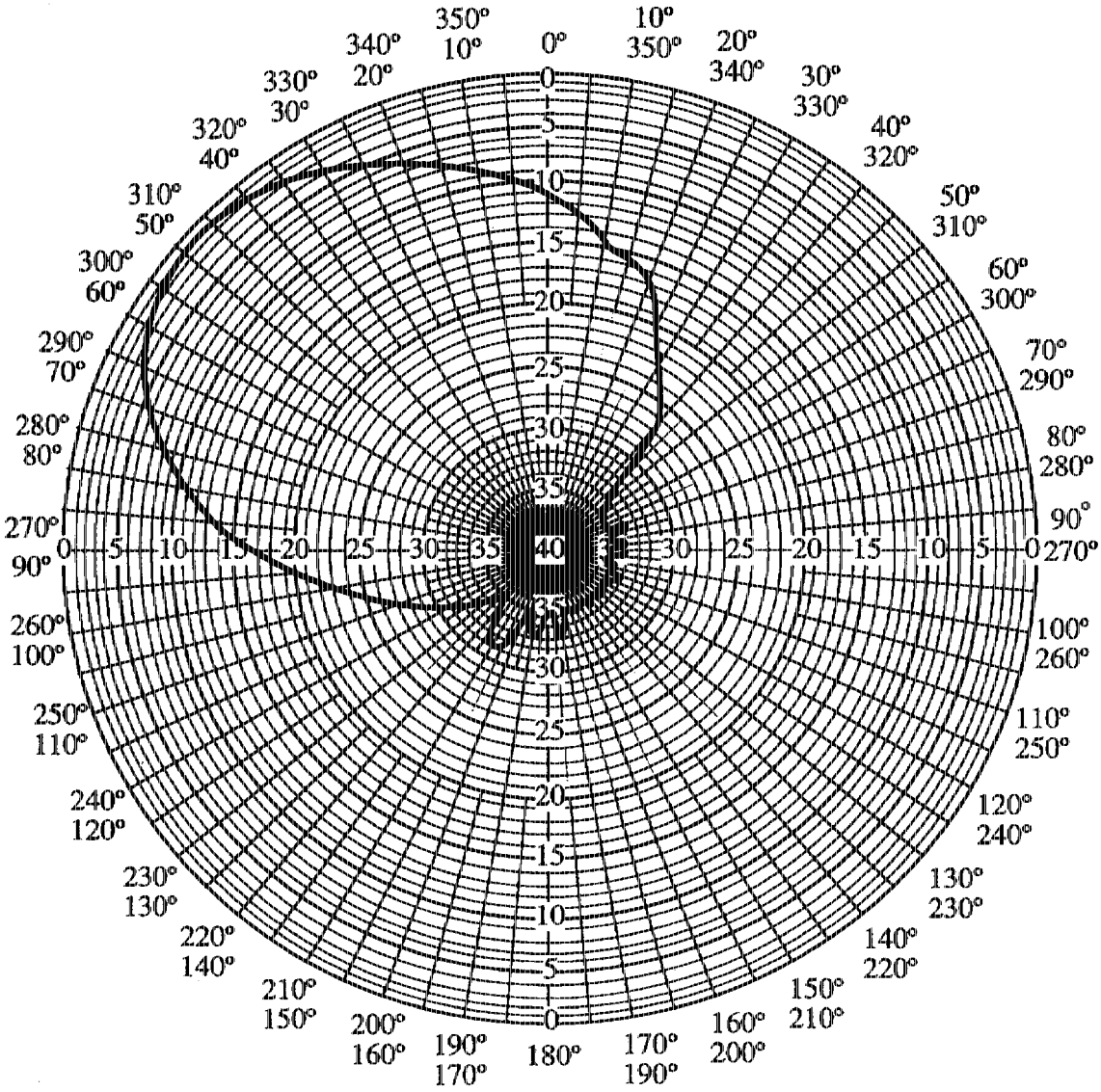

Referring to FIGS. 5A and 5B, graphical representations in the azimuth and elevational dimensions are respectively provided of an antenna beam produced by a corner reflector antenna array including 16 bow-tie dipoles operative at 14.0 GHz. It is apparent that the elevational beam width of FIG. 5B is relatively wide in comparison with the azimuth beam width depicted in FIG. 5A. This wide elevational beam allows the inventive antenna array to communicate with signal sources at a variety of elevation angles, and eliminates the necessity for rotation of the antenna in the elevational dimension. This simplifies implementation of the antenna array, since in the preferred embodiment rotation only occurs in only one (i.e., the azimuth) dimension.

The previous description of the preferred embodiments is provided to enable any person skilled in the art to make or use the present invention. The various modifications to these embodiments will be readily apparent to those skilled in the art, and the generic principles defined herein may be applied to other embodiments without the use of inventive faculty. Thus, the present invention is not intended to be limited to the embodiments shown herein but is to be accorded the widest scope consistent with the principles and novel features disclosed herein.

We claim:

1. An antenna array comprising:

a corner reflector having first and second continuous reflective surfaces which intersect to form a corner;

a dielectric substrate positioned between said corner and an opposite end of said first continuous reflective surface, said dielectric substrate defining at least one surface opposed to said second continuous reflective surface;

a plurality of dipole elements arranged upon said at least one surface of said dielectric substrate; and means for coupling, at least partially disposed upon said one surface of said dielectric substrate, said plurality of dipole elements to an antenna feed line.

2. The antenna array of claim 1 wherein said means for coupling includes a balun circuit coupled to said antenna feed line, said balun circuit including first and second conductive portions respectively disposed upon said at least one surface and upon an opposing surface of said dielectric substrate.

3. The antenna array of claim 2 wherein said means for coupling includes a distribution network having a twin line interconnection circuit interposed between said balun circuit and said plurality of dipole elements, said twin line interconnection circuit including at least first and second interconnection lines printed in mutual alignment upon said at least one surface and said opposing surface of said dielectric substrate, respectively.

4. The antenna array of claim 3 wherein said dielectric substrate is oriented parallel to said second continuous reflective surface and wherein said antenna array defines a radiation aperture transverse to said second continuous reflective surface, said twin line interconnection circuit and said balun circuit being removed from said radiation aperture relative to said plurality of dipole elements.

5. The antenna array of claim 1 wherein each of said plurality of dipole elements includes a first half dipole disposed on said at least one surface of said dielectric substrate and a second half dipole disposed on an opposing surface of said dielectric substrate.

6. The antenna array of claim 5 wherein herein said means for coupling includes a distribution network disposed upon said at least one surface of said dielectric substrate and upon said opposing surface of said dielectric substrate.

7. The antenna array of claim 6 wherein said distribution network includes a twin line interconnection network comprising a plurality of twin line interconnection lines coupled to said plurality of dipole elements, each of said plurality of twin line interconnection lines including a first interconnection line connected to one of said first half dipoles and a second interconnection line connected to one of said second half dipoles.

8. The antenna array of claim 1 wherein said one surface and another surface defined by said dielectric substrate are oriented parallel to said second continuous reflective surface.

9. The antenna array of claim 8 wherein said one surface and said another surface defined by said dielectric substrate contact said first continuous surface.

10. The antenna array of claim 1 wherein said one surface of said dielectric substrate contacts said first continuous reflective surface.

11. The antenna array of claim 1 wherein said plurality of dipole elements are positioned nearer said corner than said means for coupling said plurality of dipole elements.

12. An antenna array disposed to be driven by a coaxial feed line, said antenna array comprising:

a substantially right-angle corner reflector having a first continuous reflective surface and a second continuous reflective surface which intersect to form a corner;

a dielectric substrate positioned between said corner and an opposite end of said first continuous reflective surface, said dielectric substrate defining first and second opposing substrate surfaces oriented parallel to said second continuous reflective surface;

a plurality of dipole elements, each of said dipole elements including a first half dipole printed on said first substrate surface and a second half dipole printed on said second substrate surface; and means for coupling said plurality of dipole elements to said coaxial feed line.

13. The antenna array of claim 12 wherein said means for coupling includes a twin line interconnection network comprising a plurality of first and second transmission line segments coupled to said plurality of dipole elements, wherein the first half dipole of at least one of said dipole elements is connected to one of said first transmission line segments disposed upon said first substrate surface and the second half dipole thereof is connected to one of said second transmission line segments disposed upon said second substrate surface opposite said first transmission line segment.

14. The antenna array of claim 13 wherein said means for coupling further includes a balun circuit disposed on said first and second substrate surfaces, said balun circuit connecting a center conductor of said coaxial feed line to said first transmission line segments and connecting an outer conductor of said coaxial feed line to said second transmission line segments.

15. The antenna array of claim 13 wherein said substantially right-angle corner reflector defines a radiation aperture, said twin line interconnection network being disposed upon said first and second substrate surfaces distal said radiation aperture.

16. The antenna array of claim 12 wherein said plurality of dipole elements comprises a plurality of bow-tie dipole antenna elements.

17. The antenna array of claim 12 further including a dielectric spacer disposed between said second continuous reflective surface and said second substrate surface, said coaxial feed line including a center conductor extending through said dielectric spacer and said dielectric substrate.

18. The antenna array of claim 12 wherein said plurality of dipole elements are positioned nearer said corner than said means for coupling said plurality of dipole elements.

19. The antenna array of claim 12 wherein said first and second opposing surfaces of said dielectric substrate contact said first continuous surface.

20. An antenna array comprising:

a corner reflector having first and second reflective surfaces, said first and second reflective surfaces being arranged in accordance with a desired elevational beamwidth of said antenna array;

a dielectric substrate defining a lateral end in contact with said first reflective surface, said dielectric substrate disposed upon said first reflective surface defining at least one surface transverse to said lateral end and opposed to second reflective surface;

a plurality of dipole elements arranged upon said at least one surface of said dielectric substrate; and means for coupling said plurality of dipole elements to an antenna feed line.

21. The antenna array of claim 20 wherein said first and second reflective surfaces form continuous surfaces.

22. The antenna array of claim 21 wherein said means for coupling includes a balun circuit having a first portion disposed upon said at least one surface of said dielectric substrate.

23. The antenna array of claim 20 wherein said first and second reflective surfaces define a corner of said corner reflector, said plurality of dipole elements being nearer said corner than said means for coupling said plurality of dipole elements.

* * * * *